US008714410B2

(12) United States Patent
Wadle et al.

(10) Patent No.: US 8,714,410 B2
(45) Date of Patent: May 6, 2014

(54) DISPENSER WITH ALIGNED SPINNER MOTOR AND VALVE ASSEMBLY FOR DISPENSING FLOWABLE PRODUCT

(75) Inventors: Stephen M. Wadle, Beloit, WI (US); Robert K. Newton, Beloit, WI (US); Peter F. McNamee, Beloit, WI (US)

(73) Assignee: Carrier Corporation, Farmington, CT (US)

( * ) Notice: Subject to any disclaimer, the term of this patent is extended or adjusted under 35 U.S.C. 154(b) by 205 days.

(21) Appl. No.: 12/939,263

(22) Filed: Nov. 4, 2010

(65) Prior Publication Data

US 2011/0114664 A1 May 19, 2011

Related U.S. Application Data

(60) Provisional application No. 61/261,565, filed on Nov. 16, 2009.

(51) Int. Cl.

| | |
|---|---|
| ***B67D 7/78*** | (2010.01) |
| ***B67D 7/80*** | (2010.01) |
| ***B67D 3/00*** | (2006.01) |
| ***B67D 7/06*** | (2010.01) |

(52) U.S. Cl.

USPC ..... 222/145.6; 222/146.6; 222/504

(58) Field of Classification Search

USPC ..... 222/504, 145.6, 146.6; 251/129.1–129.13; 62/389, 390, 392

See application file for complete search history.

(56) References Cited

U.S. PATENT DOCUMENTS

| | | | | |
|---|---|---|---|---|
| 3,180,110 | A * | 4/1965 | Dunn | 62/343 |
| 3,224,740 | A * | 12/1965 | Kuehn et al. | 426/564 |
| 3,482,463 | A * | 12/1969 | Huydts et al. | 74/89.25 |
| 3,830,407 | A | 8/1974 | Wierlo | |
| 3,934,427 | A | 1/1976 | Keyes | |
| 3,934,759 | A | 1/1976 | Giannella et al. | |
| 4,922,725 | A * | 5/1990 | Rasmussen | 62/136 |
| 4,951,915 | A * | 8/1990 | Piao | 251/14 |
| 5,137,257 | A * | 8/1992 | Tice | 251/129.11 |
| 5,244,020 | A * | 9/1993 | Bruno et al. | 141/83 |
| 5,494,194 | A * | 2/1996 | Topper et al. | 222/146.6 |
| 5,556,268 | A * | 9/1996 | Topper et al. | 417/553 |
| 5,588,637 | A * | 12/1996 | Carsten et al. | 251/129.03 |
| 5,782,410 | A * | 7/1998 | Weston | 239/63 |
| 6,145,701 | A | 11/2000 | Van Der Merwe et al. | |
| 6,149,035 | A * | 11/2000 | Gorski et al. | 222/129.4 |
| 6,892,899 | B2 | 5/2005 | Minard et al. | |
| 7,261,131 | B2 * | 8/2007 | Cleveland et al. | 141/192 |
| 7,451,613 | B2 * | 11/2008 | Barraclough et al. | 62/343 |

(Continued)

*Primary Examiner* — Paul R Durand
*Assistant Examiner* — Vishal Pancholi
(74) *Attorney, Agent, or Firm* — Miller, Matthias & Hull LLP

(57) ABSTRACT

A dispenser (20) for consumable products uses a single motor (40) to both drive a spinner (75) to mix the product and move a valve assembly (42) to open and close the dispenser (20). The valve assembly (42), which is axially aligned with the motor shaft (44) may be opened and closed by fixing an externally threaded shaft (46) on a drive shaft (44) extending from the motor (40) and then rotatably mounting an internally threaded flywheel (50) on the threaded shaft (46). A valve stem (64) may then be fixedly attached to the flywheel (50). When the motor (40) energizes, the flywheel (50) and valve stem (64) axially translate along the nut (46) to open the valve assembly (42). When the motor (40) de-energizes, the flywheel (50) and valve stem (64) axially translate along the nut (46) in an opposite direction to close the valve assembly (42).

16 Claims, 6 Drawing Sheets

(56) References Cited

U.S. PATENT DOCUMENTS

| | | | | |
|---|---|---|---|---|
| 2005/0279764 | A1 | 12/2005 | Minard et al. | |
| 2006/0255066 | A1 * | 11/2006 | Kannar et al. | 222/145.3 |
| 2007/0131715 | A1 | 6/2007 | Minard et al. | |
| 2008/0028724 | A1 | 2/2008 | Petit et al. | |
| 2008/0127837 | A1 | 6/2008 | Cocchi et al. | |
| 2008/0302818 | A1 | 12/2008 | Minard et al. | |

* cited by examiner

DISPENSER WITH ALIGNED SPINNER MOTOR AND VALVE ASSEMBLY FOR DISPENSING FLOWABLE PRODUCT

CROSS-REFERENCE TO RELATED APPLICATION

This application is a non-provisional patent application claiming priority under 35 USC §119(e) to U.S. Provisional Patent Application Ser. No. 61/261,565 filed on Nov. 16, 2009.

BACKGROUND

1. Technical Field

The present disclosure generally relates to valves and motors and, more particularly, relates to valves and motors for dispensing flowable products.

2. Description of the Related Art

Automated food dispensers greatly increase the ease and speed with which patrons can be served, while at the same time ensuring quality standards are met and repeatable. Fast food restaurants and cafeterias heavily rely on such dispensers to meet the needs of their diners in a cost effective and timely manner.

One example is a milkshake dispenser. With conventional milkshake dispensers, a spinner or other type of mechanical mixer is provided within a dispensing nozzle. The mixing chamber is fluidically connected to a supply of ice cream and one or more flavoring syrups. A spinner motor is operatively connected to the spinner such that upon energizing, the spinner mixes the ice cream and flavoring.

To control flow through the dispensing nozzle, a draw valve is often employed. Such a valve may have a valve body within which a valve stem reciprocates. In order to control movement of the valve stem, convention milkshake dispensers typically use a solenoid actuator or linear actuator. The draw valve may have a top plate to which a plunger of the solenoid is attached. The plunger itself is adapted to reciprocate with a coil housing of the solenoid. However, as the spinner motor is typically mounted in axial alignment with the draw valve, the solenoid actuator has heretofore had to be mounted in offset fashion relative to the longitudinal axis of the draw valve. While effective, this results in the undesirable moment in the system that creates a side load on the solenoid, particularly between the outer diameter of the solenoid plunger and the inner diameter of the coil housing. This in turn results in increased wear and decreased serviceable life of the solenoid.

Accordingly, it can be seen that a need exists for an improved dispenser for flowable products, particularly automated milkshake dispensers.

SUMMARY OF THE DISCLOSURE

In accordance with one aspect of the disclosure, a product dispenser is disclosed which comprises a motor, a shaft extending from the motor, a threaded shaft attached to the shaft, a flywheel rotatably attached to the threaded shaft, a mixing chamber having an outlet, and a valve adapted to move relative to the mixing chamber outlet, the valve being attached to the flywheel.

In accordance with another aspect of the disclosure, a method of dispensing a product is disclosed which comprises providing a motor having a motor shaft and an externally threaded shaft attached thereto, threadably attaching a flywheel to the threaded shaft, fixedly attaching a valve stem to the flywheel, the valve stem being movably mounted in a valve body to form a valve assembly, and energizing the motor to thereby cause the motor shaft and threaded shaft to rotate, the inertia of the flywheel causing the flywheel to accelerate more slowly than the shaft and thus causing the flywheel to axially translate along the threaded shaft in a first direction, axial translation of the flywheel along the threaded shaft causing the valve stem to move within the valve body and open the valve assembly.

In accordance with yet another aspect of the disclosure, a milkshake dispenser is disclosed which comprises a mixing chamber, a spinner mounted in a valve body, a supply of ice cream connected to the mixing chamber, a supply of flavored syrup connected to the mixing chamber, a motor operatively connected to the spinner, and a valve assembly for opening and closing the mixing chamber to dispense the milkshake, the valve assembly and the spinner both being driven by the motor.

These are other aspects and features of the disclosure will become more apparent upon reading the following detailed description when taken in conjunction with the accompanied drawings.

While the present disclosure is susceptible of various modifications and alternative constructions, certain illustrative embodiments thereof will be shown and described below in detail. It should be understood, however, that there is no intention to be limited to the specific embodiments disclosed, but on the contrary, the intention is to cover all modifications, alternative constructions, and equivalents falling within the spirit and scope of the present disclosure.

DETAILED DESCRIPTION OF THE DRAWINGS

Figure 1:
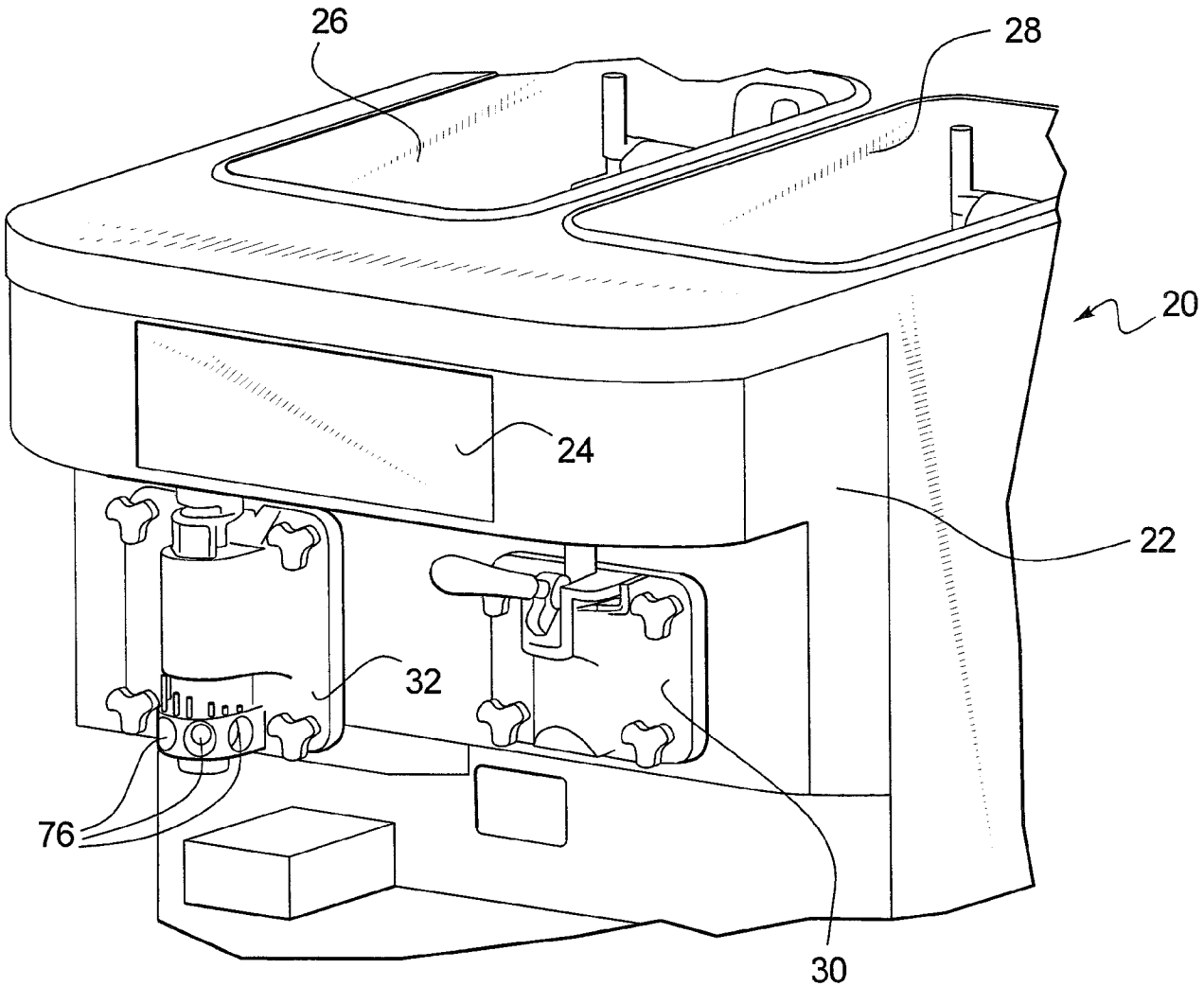
FIG. 1 is an isometric view of a exemplary milkshake dispenser built in accordance with the teaching of the disclosure.

Referring now to the drawings, and with particular reference to FIG. 1, a dispenser constructed in accordance with the teachings of the disclosure is generally referred to by reference numeral 20. While the following detailed description and drawings are made in reference to a soft-serve ice cream and milkshake dispenser, it is to be understood that the teachings of the disclosure can be used to manufacture valves and motor assembly for use with many other types of flowable product dispensers including, but not limited to, other food products, beverages, cleaning products and the like.

Referring again to FIG. 1, the dispenser 20 may include a housing 22 having an operator interface 24, reservoirs 26 and 28 for supplies of ice cream and flavoring syrups, as well as soft-serve ice cream dispensing nozzle 30, and a milkshake dispensing nozzle 32. In other embodiments, the milk shake dispensing nozzle 32 can be provided as a stand-alone unit without the soft-serve ice cream dispensing nozzle 30, and vice versa.

Figure 4:
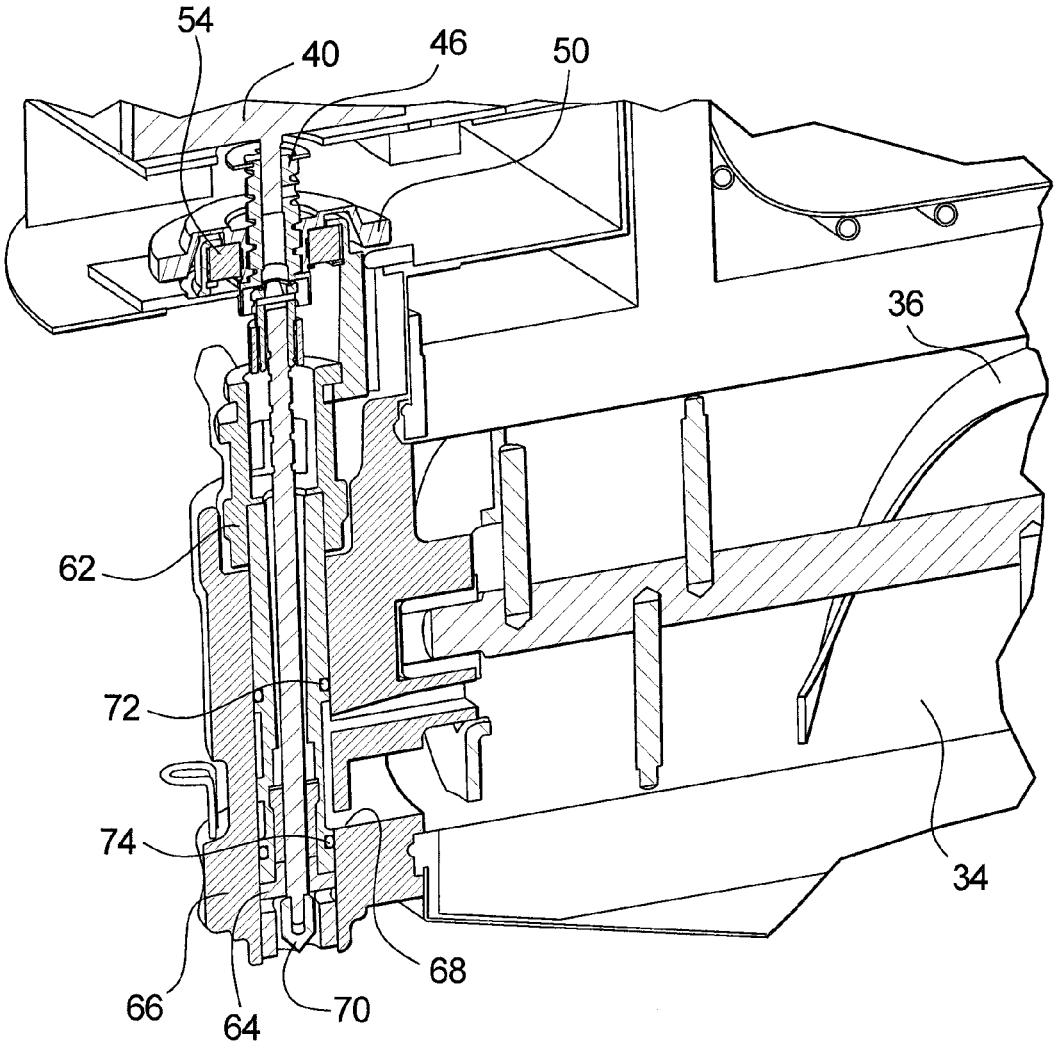
FIG. 4 is a cross-sectional view similar to FIG. 3, but also showing the entire valve assembly in a closed position.
Figure 5:
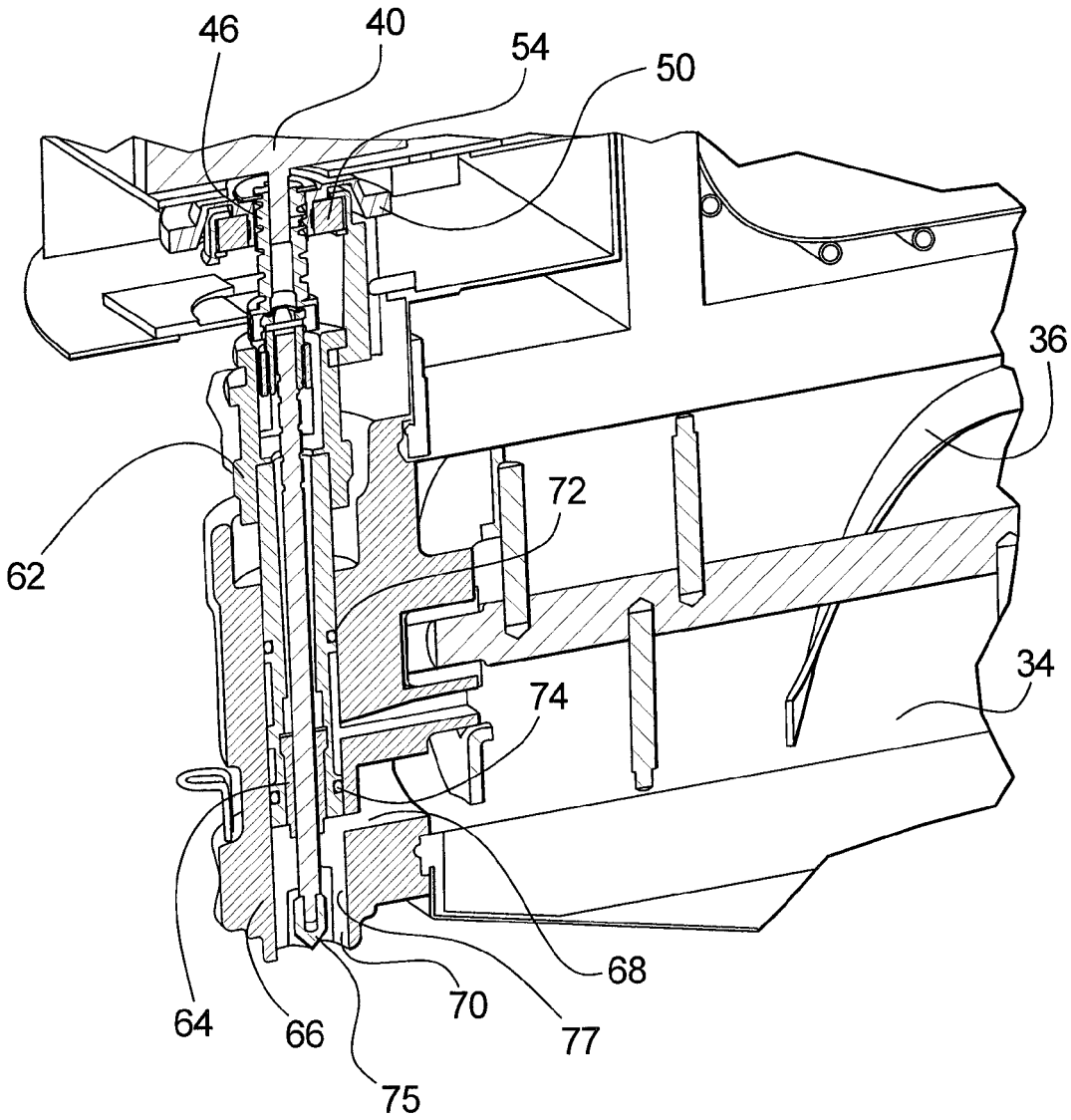
FIG. 5 is a cross-sectional view similar to FIG. 4, but showing the valve assembly in an open position.

By way of overview, and with particular reference to FIGS. 4 and 5, the dispenser 20 may include a mixing chamber 34 within which a screw conveyor or extruder 36 or the like is provided. At the direction of the operator interface 24 and associated microprocessor 38, supplies of ice cream and flavoring are added to a mixing cavity 77 to make the desired form of milkshake. A motor 40 is operatively coupled to a spinner 75 to mix the ingredients. While the present disclosure is made with reference to the spinner 75 being the prime mechanical actuator to mix the flowable product within the mixing cavity 77, it is to be understood that other mechanical arrangements as known to those of ordinary skill in the art can be similarly employed.

Figure 2:
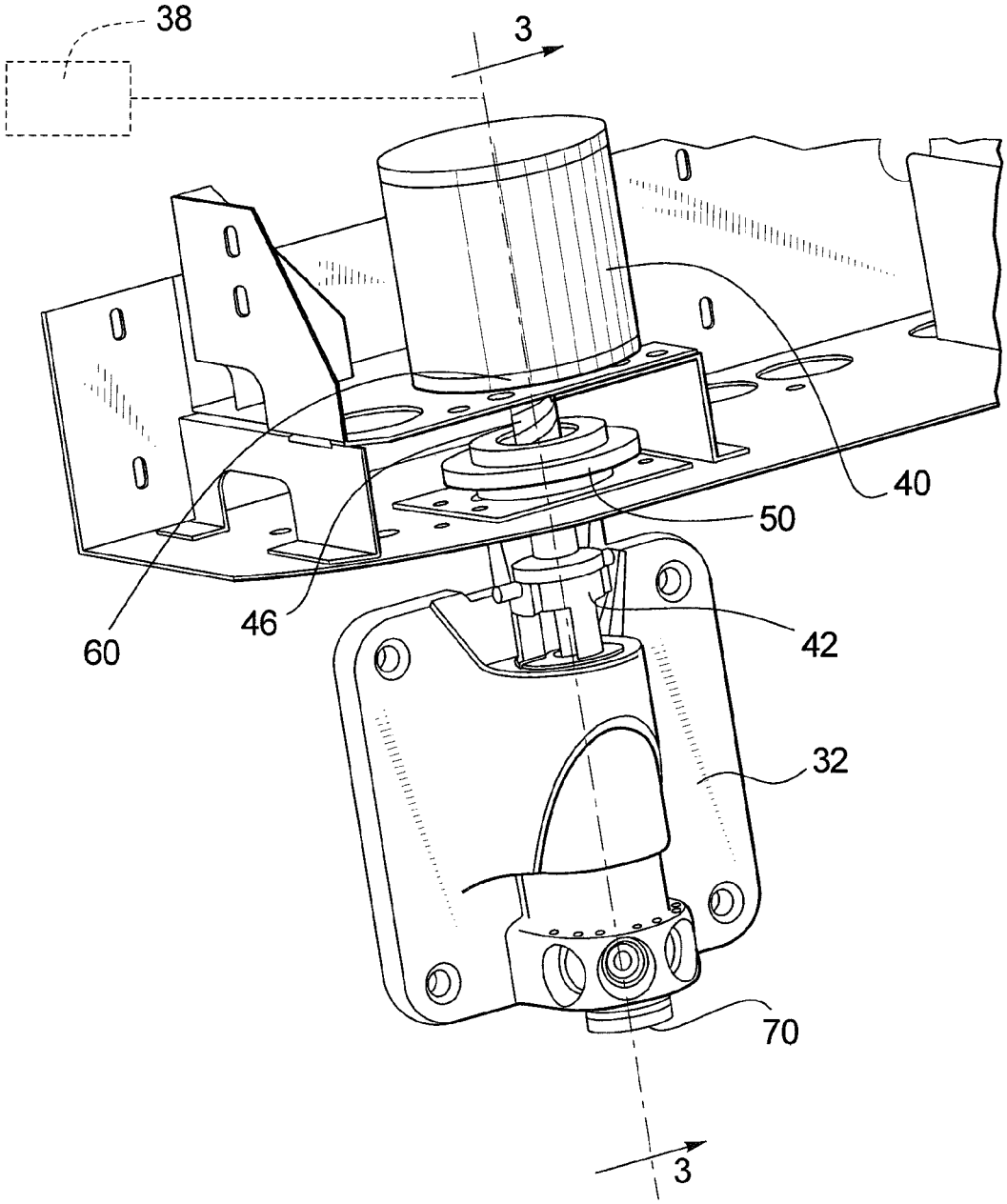
FIG. 2 is an isometric view of only the motor and valve assembly of the dispenser of FIG. 1.

In order to control flow of the milkshake through the dispensing nozzle 32, a valve assembly 42, such as the draw valve is provided. As will be described in further detail herein, opening and closing of the valve assembly 42 is controlled by the same motor 40 that controls rotation of the spinner 75. Importantly, and as shown best in FIG. 2, the valve assembly 42 is provided in axial alignment with the motor 40 as shown by longitudinal axis $\alpha$.

Figure 3:
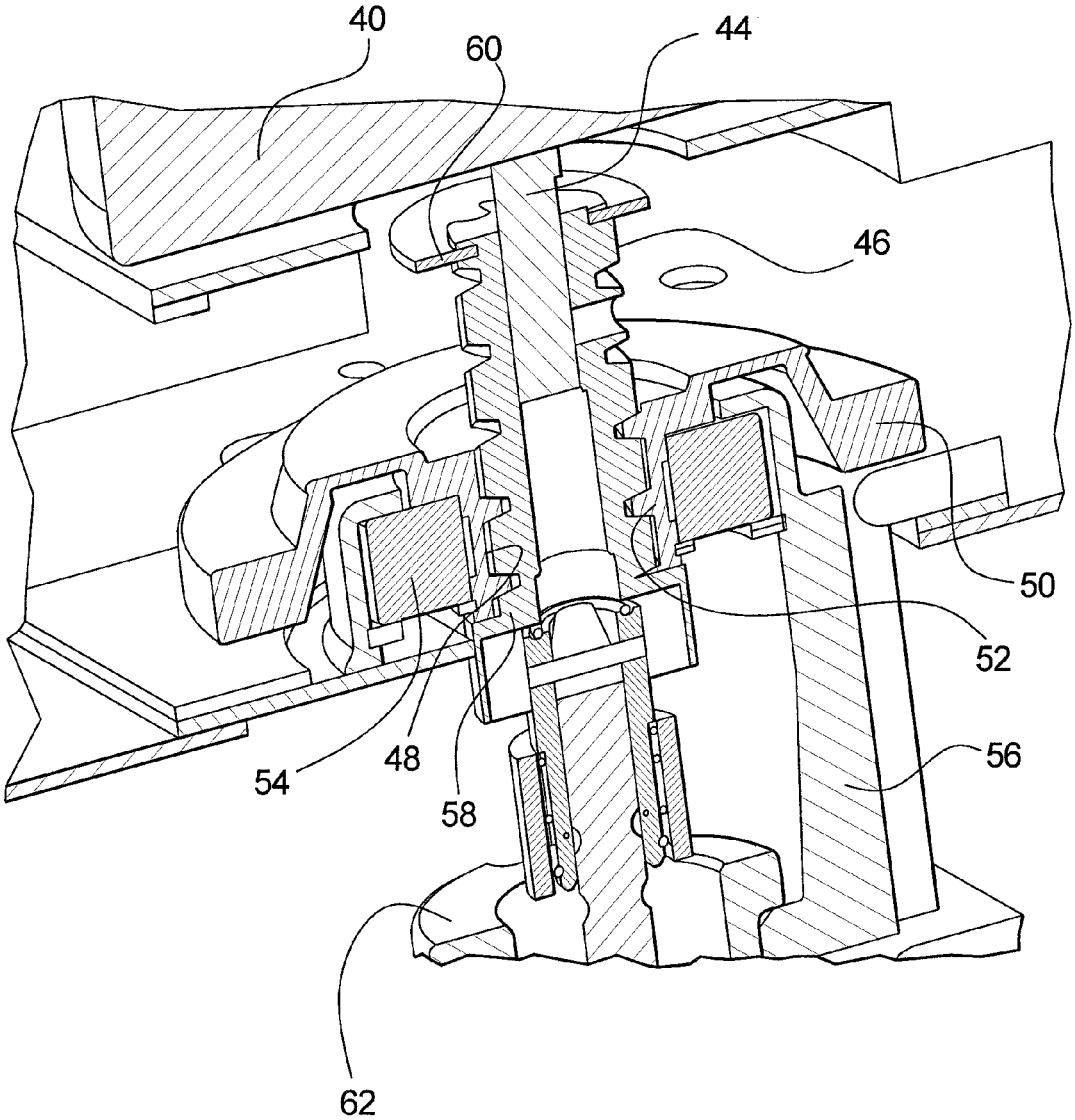
FIG. 3 is a cross-sectional view of a portion of the motor and valve assembly of FIG. 2, taken along line 3-3 of FIG. 2.

Referring now to FIG. 3, the motor 40 is shown to have a drive shaft 44 extending therefrom and to which is fixedly attached a threaded shaft 46. In alternative embodiments the drive shaft 44 and threaded shaft 46 may be the same shaft. The threaded shaft 46 includes a plurality of external threads 48. Rotatably mounted to the threaded shaft 46 is a flywheel 50. The flywheel 50 includes a plurality of internal threads 52 with the same pitch as threads 48 to thus allow the flywheel 50 to mate to the threaded shaft 46. An annular bearing 54 is mounted to a coupling 56 to rotatably fix the flywheel 50 while at the same time allowing the flywheel to axially translate along the threaded nut 46. The nut 46 is provided with a positive stop 58 to limit axial translation in a first direction, while a ring 60 is provided within the housing 22 to positively stop and limit axial translation in a second direction opposite to the first direction.

As illustrated best in FIGS. 4 and 5, the same coupling 56 which mounts the bearing 54 also axially attaches the flywheel 50 to a secondary coupling 62 which in turn is connected to a valve stem 64 forming part of the valve assembly 42. The valve stem 64 axially reciprocates with a valve body 66 also forming part of the valve assembly 42. Since the valve stem 64 is axially fixed to the flywheel 50, as the flywheel 50 axially translates along the threaded shaft 46, the valve stem 64 reciprocates within the valve body 66 to open or close the valve assembly 42.

More specifically, as again shown best in FIGS. 4 and 5, the mixing chamber 34 includes a product outlet 68 proximate to a outlet 70 for the dispenser 20 as a whole. When the valve assembly 42 is closed, the valve stem 64 is positioned so as to block fluid communication between the product outlet 68 and the dispenser outlet 70. The valve stem 64 may include one or more sealing or o-rings 72 and 74 to ensure such fluid communication is substantially sealed off when desired. However, when the valve stem 64 reciprocates toward the motor 40, the valve assembly 42 is opened in that the product outlet 68 is placed in fluid communication with dispenser outlet 70. The milkshake can then be dispensed.

Figure 6:
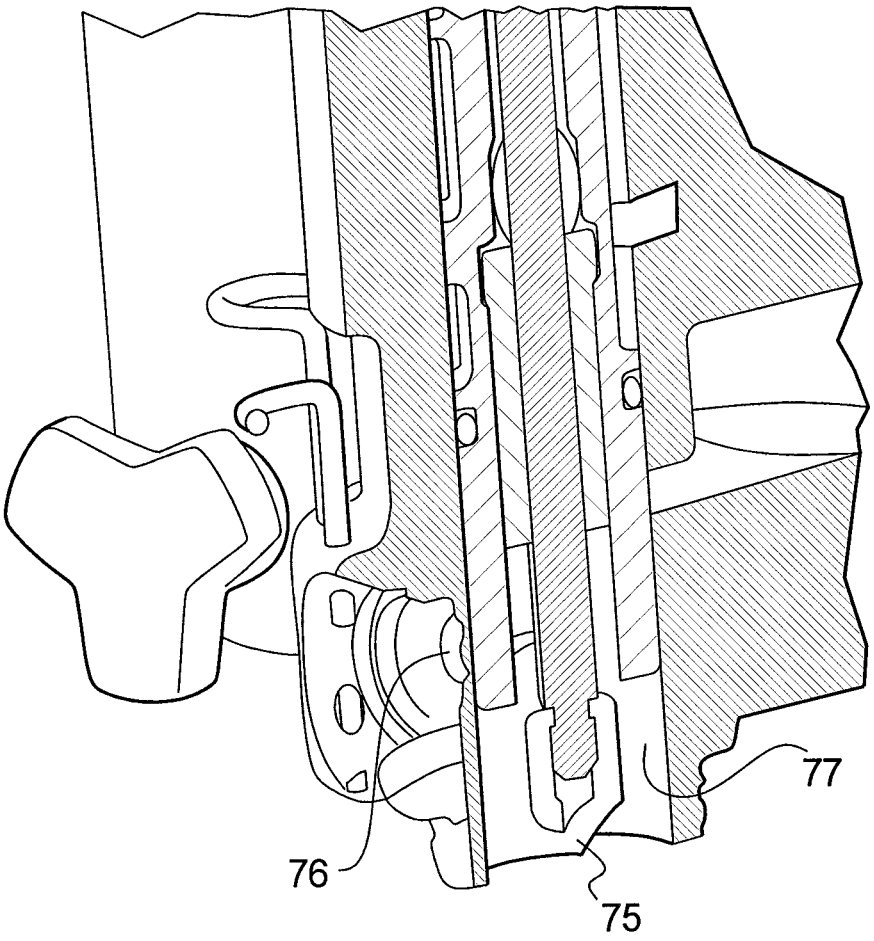
FIG. 6 is a cross-section view showing one of the syrup injection points in greater detail.

In use, the dispenser 20 is operated by first entering the appropriate commands through the operator interface 24. Such commands would typically include desired flavor and volume. The microprocessor 38 then controls internal valves and apparatus (not shown) to allow for appropriate amounts of ice cream and flavorings into the mixing chamber 34, while energizing the motor 40. As shown best in FIG. 6, multiple flavoring injection ports 76 may be provided into the mixing chamber 34, with four such ports being provided in one embodiment. Energizing the motor 40 does at least two things. One, it causes the spinner 75 within the mixing chamber to begin rotating and thus mixing the ice cream and flavorings to churn a milkshake. At the same time, it causes the valve assembly 42 to being its opening sequence.

In other words, when the motor 40 turns on, it immediately begins to accelerate at a first rate to its predetermined speed. However, as the flywheel 50 is not rotationally fixed to the shaft 44 of the motor 40, but rather is mounted using the threaded nut 46, its inertia causes the flywheel 50 to accelerate at a second rate which is slower than the first rate. As the shaft 44 and nut 46 are therefore rotating, at least initially, at a faster speed than the flywheel 50, this causes the flywheel 50 to axially translate toward the motor 40. In turn, as the flywheel 50 is axially fixed to the valve stem 64, this causes the valve stem 64 to move with the flywheel 50 toward the motor 40 and away from the product outlet 68 to open the valve assembly 42.

The valve assembly 42 will then stay open and the spinner 75 will continue to rotate for a duration long enough to allow for the desired volume of milkshake to be dispensed. However, as that volume is about to be reached, the microprocessor 38 will de-energize the motor 40. At this point, though, the momentum of the flywheel 50 causes it to decelerate at a rate that is slower than the rate of deceleration of the motor shaft 44 and the threaded shaft 46. As a result, the flywheel 50 axially translates along the nut 46 away from the motor 40. Since the flywheel 50 is axially fixed to the valve stem 64, this causes the valve stem 64 to move toward the product outlet 68, eventually severing fluid communication to the dispenser outlet 70 and closing the valve assembly 42. The motor 40 may also be actively decelerated through a brake, regenerative braking, or by reversing the motor 40.

It is to be understood that while the foregoing description has been given with reference to a draw valve, the teachings of this disclosure can be used in conjunction with other types of valves known to those of ordinary skill in the art to enable the valve and the motor to be axially aligned, avoid undesirable moments, remove offset loadings, and save costs by allowing a single motor to drive both the product conveyor and the valve assembly.

Industrial Applicability

Based on the foregoing, it can be seen that the present disclosure sets forth a dispenser for flowable products, such as but not limited to, milkshakes. The teachings of this disclosure can be employed to allow a single motor to drive the spinner, mixer, or conveyor of such a dispenser, while at the same time opening and closing the valve of the dispenser. Moreover, through the novel arrangement of mechanical components set forth above, the motor and valve assembly are axially aligned to thereby avoid any offset loading and premature parts wear associated with prior art dispensers, particularly those employing solenoid valve actuators or linear motor valve actuators.

While only certain embodiments have been set forth, alternatives and modifications will be apparent from the above description to those skilled in the art. These and other alternatives are considered equivalents and within the spirit and scope of this disclosure and the appended claims.

What is claimed is:

1. A product dispenser (20), comprising:

a motor (40);

a shaft (44) extending from the motor (20);

a threaded shaft (46) attached to the shaft (44);

a flywheel (50) rotatably mounted on the threaded shaft (46);

a mixing chamber (34) having an outlet (68);

a valve assembly (42) adapted to move relative to the mixing chamber outlet (68), the valve assembly (42) being attached to the flywheel (50); and a spinner (75) rotatably mounted within the valve assembly (42), wherein a single actuation of the motor (40) rotates the spinner (75) around a vertical axis and axially translates the valve assembly (42) to open and close the product dispenser (20).

2. The product dispenser (20) of claim 1, wherein the flywheel (50), motor (40), shaft (44), threaded shaft (46) and valve assembly (42) are axially aligned.

3. The product dispenser (20) of claim 1, wherein the motor (40) accelerates at a first rate, and the flywheel (50) accelerates at a second rate, the first rate being greater than the second rate.

4. The product dispenser (20) of claim 1, wherein the motor (40) decelerates at a first rate, and the flywheel (50) decelerates at a second rate, the first rate of deceleration being greater than the second rate of deceleration.

5. The product dispenser (20) of claim 1, wherein the mixing chamber (34) is filled with a dairy product.

6. The product dispenser (20) of claim 5, wherein the dairy product is a milkshake.

7. A method of dispensing a product, comprising:

providing a motor (40) having a motor shaft (44) and an externally threaded shaft (46) attached thereto and operatively coupling the motor (40) to a spinner (75);

threadably mounting a flywheel (50) to the threaded shaft (46);

fixedly attaching a valve stem (64) to the flywheel (50), the valve stem (64) being movably mounted in a valve body (66) to form a valve assembly (42); and energizing the motor (40) to cause the motor shaft (44) and threaded shaft (46) to rotate, the inertia of the flywheel (50) causing the flywheel (50) to accelerate more slowly than the shaft (44) and thus causing the flywheel (50) to axially translate along the threaded shaft (46) in a first direction, axial translation of the flywheel (50) along the threaded shaft (46) causing the valve stein (64) to move within the valve body (66) and open the valve assembly (42), the same operation of energizing the motor also driving the spinner for mixing the product before dispensing.

8. The method of claim 7, wherein the valve stem (64) and flywheel (50) are mounted so as to be axially aligned with the motor shaft (44).

9. The method of claim 7, further including de-energizing the motor (40) to thereby cause the motor shaft (44) and threaded nut (46) to stop rotating, the momentum of the flywheel (50) causing the flywheel (50) to decelerate more slowly than the shaft (44) and thus cause the flywheel (50) to axially translate along the threaded shaft (46) in a second direction, axial translation of the flywheel (50) along the threaded shaft (46) in the second direction causing the valve stein (64) to move with the valve body (66) to close the valve assembly (42).

10. The method of claim 8, wherein the product is a dairy product.

11. The method of claim 10, wherein the dairy product is a milkshake.

12. A milkshake dispenser (20), comprising:

a mixing chamber (34);

a spinner (75) mounted in a valve stem (64);

a supply of ice cream (26) connected to the mixing chamber (34);

a supply of flavored syrup (76) connected to a valve body (66);

a motor (40) operatively connected to the spinner (75); a shaft (44) extending from the motor (40); a threaded shaft (46) mounted to shaft (44), the threaded shaft (46) being axially fixed to the shaft (44) and including a plurality of external threads (48); a flywheel (50) rotatably mounted on to the threaded shaft (46); and a valve assembly (42) for opening and closing the mixing chamber (34) to dispense the milkshake, the valve assembly (42) and the spinner (75) both being driven by a single operation of energizing or de-energizing the motor (40).

13. The milkshake dispenser (20) of claim 12, further comprising:

wherein the flywheel (50) having a plurality of internal threads mated to the external threads (48) of the shaft (46);

a valve stem (64) fixedly mounted to the flywheel (50);

a valve body (66), the valve stem (64) movably mounted within the valve body (66) between valve open and valve closed positions; and positive stops (58, 60) flanking the threaded shaft (46) to limit the axial movement of the flywheel (50) between the valve open and valve closed positions.

14. The milkshake dispenser (20) of claim 13, wherein the valve stem (64) and motor shaft (44) are axially aligned.

15. The milkshake dispenser (20) of claim 12, wherein the motor (40) accelerates at a first rate, and the flywheel (50) accelerates at a second rate, the first rate being greater than the second rate.

16. The milkshake dispenser (20) of claim 12, wherein the motor (40) decelerates at a first rate, and the flywheel (50) decelerates at a second rate, the first rate of deceleration being greater than the second rate of deceleration.

* * * * *